US011281118B2

(12) United States Patent
Hanatani et al.

(10) Patent No.: US 11,281,118 B2
(45) Date of Patent: Mar. 22, 2022

(54) TONER, TONER ACCOMMODATING CONTAINER, DEVELOPER, DEVELOPING DEVICE, PROCESS CARTRIDGE, IMAGE FORMING APPARATUS, AND IMAGE FORMING METHOD

(71) Applicant: RICOH COMPANY, LTD., Tokyo (JP)

(72) Inventors: Shinya Hanatani, Kanagawa (JP); Masayuki Ishii, Shizuoka (JP); Hyo Shu, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/929,337

(22) Filed: Jul. 15, 2020

(65) Prior Publication Data

US 2021/0026267 A1 Jan. 28, 2021

(30) Foreign Application Priority Data

Jul. 25, 2019 (JP) ..... JP2019-136594

(51) Int. Cl.
*G03G 9/08* (2006.01)
*G03G 9/087* (2006.01)
(Continued)

(52) U.S. Cl.
CPC ..... *G03G 9/08753* (2013.01); *G03G 9/08755* (2013.01); *G03G 9/08795* (2013.01); *G03G 9/08797* (2013.01); *G03G 9/09* (2013.01); *G03G 9/09708* (2013.01); *G03G 9/09716* (2013.01); *G03G 9/1134* (2013.01); *G03G 15/08* (2013.01)

(58) Field of Classification Search
CPC ..... G03G 9/097908; G03G 9/09716; G03G 9/09708
See application file for complete search history.

(56) References Cited

U.S. PATENT DOCUMENTS 5,429,873 A * 7/1995 Deusser ..... G03G 9/09716 428/405
6,610,452 B2 * 8/2003 Combes ..... G03G 9/09708 430/108.11
(Continued)

FOREIGN PATENT DOCUMENTS

JP 60-093455 5/1985
JP 63-139364 A 6/1988
(Continued)

OTHER PUBLICATIONS

English language machine translation of JP 2007-058035 (Year: 2007).*
(Continued)

*Primary Examiner* — Mark A Chapman
(74) *Attorney, Agent, or Firm* — Grüneberg and Myers PLLC

(57) ABSTRACT

A toner comprising base particles and external additive particles covering the base particles is provided. The base particles comprise a binder resin and a colorant. The external additive particles comprise at least one member selected from the group consisting of fluorine-containing aluminum hydroxide, fluorine-containing boehmite, and fluorine-containing pseudoboehmite.

18 Claims, 3 Drawing Sheets

(51) Int. Cl.

| | |
|---|---|
| ***G03G 9/09*** | (2006.01) |
| ***G03G 9/113*** | (2006.01) |
| ***G03G 15/08*** | (2006.01) |
| ***G03G 9/097*** | (2006.01) |

(56) References Cited

U.S. PATENT DOCUMENTS

| | | | | |
|---|---|---|---|---|
| 8,178,272 | B2 * | 5/2012 | Rimoto ..... | G03G 9/09708 430/108.6 |
| 2018/0067415 | A1 | 3/2018 | Sugahara | |
| 2020/0174390 | A1 | 6/2020 | Kitada et al. | |

FOREIGN PATENT DOCUMENTS

| | | | |
|---|---|---|---|
| JP | 9-274332 | | 10/1997 |
| JP | 2004-352591 | | 12/2004 |
| JP | 2007-058035 | | 3/2007 |
| JP | 2009-227485 | A | 10/2009 |
| JP | 2010-160325 | | 7/2010 |
| JP | 2013-156489 | | 8/2013 |
| JP | 2013-177313 | A | 9/2013 |
| WO | WO2004/013703 | A1 | 2/2004 |

OTHER PUBLICATIONS

English language machine translation of JP 05-43224. (Year: 1993).*
English language machine translation of JP 05-10419. (Year: 1993).*
Extended European Search Report dated Nov. 24, 2020 in European Patent Application No. 20186660.5, 7 pages.
U.S. Appl. No. 16/778,268, filed Jan. 31, 2020, Kohtaroh Ogino, et al.
U.S. Appl. No. 16/802,336, filed Feb. 26, 2020, Masayuki Ishii, et al.

* cited by examiner

TONER, TONER ACCOMMODATING CONTAINER, DEVELOPER, DEVELOPING DEVICE, PROCESS CARTRIDGE, IMAGE FORMING APPARATUS, AND IMAGE FORMING METHOD

CROSS-REFERENCE TO RELATED APPLICATIONS

This patent application is based on and claims priority pursuant to 35 U.S.C. § 119(a) to Japanese Patent Application No. 2019-136594, filed on Jul. 25, 2019, in the Japan Patent Office, the entire disclosure of which is hereby incorporated by reference herein.

BACKGROUND

Technical Field

The present disclosure relates to a toner, a toner accommodating container, a developer, a developing device, a process cartridge, an image forming apparatus, and an image forming method.

Description of the Related Art

An electrophotographic image forming method includes a charging process, an irradiating process, a developing process, a transfer process, and a fixing process. The charging process is for applying an electric charge, by electrical discharge, to a surface of a photoconductor serving as an image bearer. The irradiating process is for irradiating the charged surface of the photoconductor to form an electrostatic latent image. The developing process is for supplying toner to the electrostatic latent image formed on the surface of the photoconductor to develop the electrostatic latent image into a toner image. The transfer process is for transferring the toner image formed on the surface of the photoconductor onto a recording medium. The fixing process is for fixing the toner image on the recording medium.

It has been difficult to simultaneously reduce wear of the photoconductor and prevent generation of fog images over time in low-temperature low-humidity environments by these techniques.

SUMMARY

In accordance with some embodiment of the present invention, a toner comprising base particles and external additive particles covering the base particles is provided. The base particles comprise a binder resin and a colorant. The external additive particles comprise at least one member selected from the group consisting of fluorine-containing aluminum hydroxide, fluorine-containing boehmite, and fluorine-containing pseudoboehmite.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
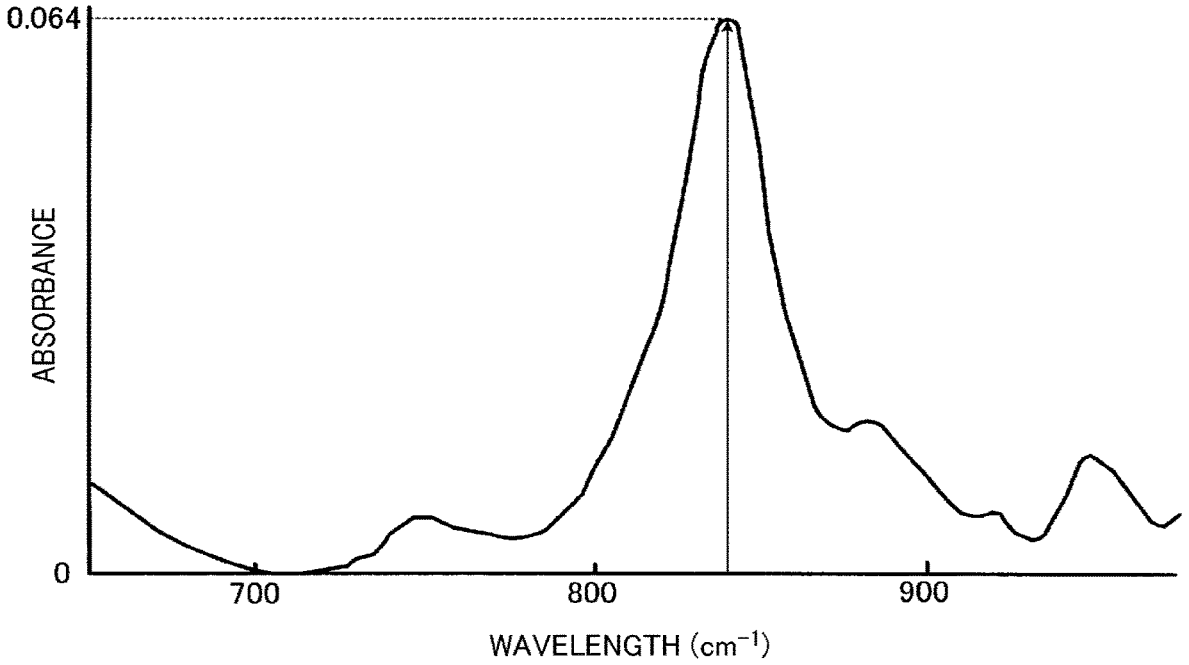
FIG. 1 is a diagram showing a characteristic spectrum of a binder resin of a toner according to an embodiment of the present invention, obtained by an FTIR-ATR (Fourier Transform Infrared Spectrometry-Attenuated Total Reflection) method.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In accordance with some embodiments of the present invention, a toner is provided that is capable of producing high-density images while reducing wear of the surface of an electrostatic latent image bearer and preventing generation of fog images over time in low-temperature low-humidity environments.

A toner according to an embodiment of the present invention comprises base particles and external additive particles covering the base particles. The base particles comprise a binder resin and a colorant. The external additive particles comprise at least one member selected from the group consisting of fluorine-containing aluminum hydroxide, fluorine-containing boehmite, and fluorine-containing pseudoboehmite.

Heretofore, no technique has been known to use, as external additive particles, aluminum hydroxide, boehmite, and pseudoboehmite that are treated with fluorine. The use of fluorine-treated alumina as an external additive has been proposed. However, fluorine-treated alumina has drawbacks that the charge level is low and fog images are generated. Further, it is also difficult to prevent wear of an electrostatic latent image bearer (hereinafter also referred to as "photoconductor") when the fluorine-treated alumina is used as external additives.

In view of this situation, in the present disclosure, at least one selected from fluorine-containing aluminum hydroxide, fluorine-containing boehmite, and fluorine-containing pseudoboehmite is used as external additive particles. Such external additive particles provide a toner capable of producing high-density images while reducing wear of the surface of the photoconductor and preventing generation of fog images over time in low-temperature low-humidity environments.

External Additive Particles

In the present disclosure, the external additive particles comprise at least one selected from fluorine-containing aluminum hydroxide, fluorine-containing boehmite, and fluorine-containing pseudoboehmite. The external additive particles may further comprise particles other than the above (hereinafter "other particles"), if necessary.

Examples of the aluminum hydroxide include, but are not limited to, amorphous aluminum hydroxide and bayerite.

Boehmite and pseudoboehmite are known and can be synthesized by conventional methods.

Incorporation of fluorine into aluminum oxide, boehmite, and pseudoboehmite can be performed by, for example, bringing these compounds into contact with a fluorine compound under heat. Examples of the fluorine compound include, but are not limited to, fluorine-containing silane coupling agents. Specific examples of the fluorine-containing silane coupling agents include, but are not limited to, silane compounds in which a hydrogen atom of an alkyl group is replaced with a fluorine atom, such as $C_8F_{17}CH_2CH_2Si(OCH_3)_3$, $C_6F_{13}CH_2CH_2Si(OCH_3)_3$, and $CF_3CH_2CH_2Si(OCH_3)_3$.

Other Particles

The other particles may be appropriately selected to suit to a particular application. Examples thereof include, but are not limited to, silica, titanium oxide, barium titanate, magnesium titanate, calcium titanate, strontium titanate, iron oxide, copper oxide, zinc oxide, tin oxide, quartz sand, clay, mica, sand-lime, diatomaceous earth, chromium oxide, cerium oxide, red iron oxide, antimony trioxide, magnesium oxide, zirconium oxide, barium sulfate, barium carbonate, calcium carbonate, silicon carbide, and silicon nitride. Each of these can be used alone or in combination with others.

The other particles may be subjected to a surface treatment for the purpose of increasing hydrophobicity of the surface and preventing deterioration of fluidity and chargeability even under high humidity.

Specific examples of the surface treatment agent include, but are not limited to, fluorine-containing silane coupling agents, silylation agents, silane coupling agents having a fluorinated alkyl group, organic titanate coupling agents, aluminum coupling agents, silicone oils, and modified silicone oils.

The amount of the at least one selected from fluorine-containing aluminum hydroxide, fluorine-containing boehmite, and fluorine-containing pseudoboehmite is preferably from 0.5 to 2.0 parts by mass, more preferably from 1.0 to 1.5 parts by mass, based on 100 parts by mass of the base particles (to be described in detail later).

When the amount is 0.5 parts by mass or more, the saturated charge value of the toner in a low-temperature low-humidity environment (for example, at a temperature of 10 degrees C. and a relative humidity of 15%) is increased, and high-density images are provided. When the amount is 2.0 parts by mass or less, fluorine derived from the external additive particles is prevented from adhering to carrier particles over time. As a result, the charging ability of the carrier is increased, the charge rising property of the toner in a low-temperature low-humidity environment is improved, the number of weakly-charged, excessively-charged, and reversely-charged toner particles is reduced, and generation of fog images is prevented. Further, wear of the photoconductor is reduced.

In the present disclosure, the external additive particles have a particle diameter (D50) of preferably from 8 to 120 nm. With this particle diameter, the toner is less prone to fluctuate in properties such as charge amount, fluidity, and cohesion, and is prevented from degrading image quality (by, for example, causing transfer failure or generating background stains). When the particle diameter is 120 nm or less, wear of the photoconductor is reduced.

More preferably, the external additive particles have a particle diameter (D50) of from 12 to 60 nm.

The particle diameter (D50) of the external additive particles can be measured by a laser diffraction particle size distribution analyzer LA-750 (manufactured by HORIBA, Ltd.).

According to the study by the inventors of the present invention, it has been found that, to improve the charge rising property that is an ability of toner to be charged in a short time upon friction with a carrier whose charging ability has deteriorated with time, there is a suitable relation between the aluminum density and the fluorine density in the surface layer of the toner particle, particularly in a region extending from the outermost surface layer of the toner particle to a depth of about 5 nm.

The toner according to an embodiment of the present invention satisfies the following formula (1), where X1 and X2 represent an aluminum density and a fluorine density, respectively, as determined by X-ray photoelectron spectroscopy (XPS).

$$2.7 \leq X1/X2 \text{ (atomic percent)} \leq 5.8 \qquad \text{Formula (1)}$$

When the ratio (X1/X2) of the aluminum density X1 to the fluorine density X2 is 2.7 or more, fluorine derived from the external additive particles is prevented from adhering to carrier particles over time. As a result, the charging ability of the carrier is increased, the charge rising property of the toner in a low-temperature low-humidity environment (for example, at a temperature of 10 degrees C. and a relative humidity of 15%) is improved, the number of weakly-charged, excessively-charged, and reversely-charged toner particles is reduced, and generation of fog images is prevented. When the ratio (X1/X2) is 5.8 or less, the fluorine density that contributes to the charge rising property of the toner is appropriate. As a result, the charge rising property of the toner in a low-temperature low-humidity environment is improved, the number of weakly-charged, excessively-charged, and reversely-charged toner particles is reduced, and generation of fog images is prevented.

When the aluminum density X1 is 2.1 or more, the saturated charge value of the toner in a low-temperature low-humidity environment (at a temperature of 10 degrees C. and a relative humidity of 15%) becomes appropriate, and high-density images are provided. When the aluminum density X1 is 3.0 or less, fluorine derived from the external additive particles is prevented from adhering to carrier particles over time. As a result, the charging ability of the carrier is increased, the charge rising property of the toner in a low-temperature low-humidity environment is improved, the number of weakly-charged, excessively-charged, and reversely-charged toner particles is reduced, and generation of fog images is prevented.

The aluminum density X1, the fluorine density X2, and the ratio X1/X2 of the toner can be measured by X-ray photoelectron spectroscopy (XPS) using the below-described instruments under the below-described measurement conditions.

Analysis equipment: AXIS-ULTRA (manufactured by Shimadzu Corporation)

X-ray: 15 kV, 9 mA, Hybrid

Neutralization gun: 2.0 A (F-Current), 1.3 V (F-Bias), 1.8 V (C-Balance)

Step: 0.1 eV (Narrow), 2.0 eV (Wide)

Pass E: 20 eV (Narrow), 160 eV (Wide)

Relative sensitivity coefficient: Use the relative sensitivity coefficient of Casa XPS Preferably, the toner according to an embodiment of the present invention further contains a releasing agent, and satisfies the formula $0.05 \leq W/R \leq 0.14$, where W and R represent heights of peaks specific to the release agent and the binder resin, respectively, measured by an attenuated total reflection method ("ATR method") using a Fourier transform infrared spectrometer ("FT-IR").

When the ratio (W/R) is 0.05 or more, the release agent (wax) is present in an appropriate region of the outermost surface layer of the toner. As a result, even the toner is under stress caused by stirring in an image forming apparatus, the external additive particles are prevented from releasing from the toner base particles. Furthermore, adhesion of fluorine to the carrier is prevented, and generation of fog images caused due to insufficient triboelectric charge rising between the toner and the carrier is prevented over time. When the ratio (W/R) is 0.14 or less, the release agent (wax) is present in an appropriate region of the outermost surface layer of the toner. As a result, even the toner is under stress caused by stirring in an image forming apparatus, embedment of colorants in the toner base particles is prevented, and a decrease of image density and generation of fog images are prevented over time.

Measurement of Peak Intensity Ratio (W/R)

In the present disclosure, the ratio (W/R) is determined from an absorbance spectrum obtained by an ATR method (total reflection method) using an FT-IR (Fourier transform infrared spectrophotometer AVATAR 370 manufactured by Thermo Electron Corporation), in which the heights of peaks specific to the release agent (wax) and the binder resin, respectively, are defined as W and R. Since the ATR method requires a smooth surface, the toner is pressure-molded to form a smooth surface. Specifically, 2.0 g of toner is pressure-molded with a load of 1 t for 60 seconds and formed into a pellet having a diameter of 20 mm.

In the present disclosure, the maximum height of a peak specific to C—H stretching of an alkyl chain of the wax (e.g., a peak observed at 2834 to 2862 $cm^{-1}$) is defined as W, and the maximum height of a peak specific to the binder resin (e.g., a peak observed at 784 to 889 $cm^{-1}$ for a polyester resin (see FIG. 1), a peak observed at 670 to 714 $cm^{-1}$ for a styrene-acrylic resin) is defined as R, and W/R is calculated as the peak intensity ratio. When the binder resin is a mixture of two or more types of resins and two or more peaks are detected, the highest peak is adopted. In the present disclosure, the spectrum is converted so that the height of peak indicates absorbance. The peak intensity ratio is calculated using absorbance values that indicate the height of peak.

Toner Base Particles

The toner base particles contain a binder resin and a colorant, preferably further contain a release agent, and may optionally contain other components as necessary.

Release Agent

The release agent is not particularly limited and can be suitably selected to suit to a particular application. Examples thereof include, but are not limited to, waxes.

Examples of the waxes include, but are not limited to: plant waxes such as carnauba wax, cotton wax, sumac wax, and rice wax; animal waxes such as beeswax and lanolin; mineral waxes such as ozokerite and ceresin; and petroleum waxes such as paraffin, microcrystalline, and petrolatum.

In addition to these natural waxes, synthetic hydrocarbon waxes (e.g., Fischer-Tropsch wax, polyethylene, polypropylene) and synthetic waxes (e.g., ester, ketone, ether) may also be used.

Examples of the waxes further include: fatty acid amide compounds such as 12-hydroxystearic acid amide, stearic acid amide, phthalic anhydride imide, and chlorinated hydrocarbon; homopolymers and copolymers of polyacrylates (e.g., poly-n-stearyl methacrylate, poly-n-lauryl methacrylate), which are low-molecular-weight crystalline polymers, such as copolymer of n-stearyl acrylate and ethyl methacrylate; and crystalline polymers having a long alkyl side chain.

Each of these release agents may be used alone or in combination with others.

Among these, carnauba wax, rice wax, ester wax, and polypropylene are preferred.

Carnauba wax is a natural wax obtained from the leaves of carnauba palm. Those with a low acid value from which free fatty acids have been eliminated are preferred because they can be uniformly dispersed in the binder resin.

Rice wax is a natural wax obtained by purifying crude wax produced in a dewaxing or wintering process in purifying rice bran oil extracted from rice bran.

An ester wax is synthesized by an esterification reaction between a monofunctional straight-chain fatty acid and a monofunctional straight-chain alcohol.

The amount of the release agent in the toner is not particularly limited and can be suitably selected to suit to a particular application. Preferably, the amount of the release agent in 100 parts by mass of the toner is from 0.5 to 20 parts by mass, more preferably from 2 to 10 parts by mass.

When the amount is 0.5 parts by mass or more, the toner exhibits excellent high-temperature offset resistance and low-temperature fixability when being fixed. When the amount is 20 parts by mass or less, heat-resistant storage stability is excellent, and high-quality images are provided. When the amount is within the preferred range, image quality and fixing stability are advantageously improved.

Binder Resin

Examples of the binder resin include: resins obtained by a condensation polymerization reaction, such as polyester, polyamide, and polyester-polyamide resin; and resins obtained by an addition polymerization reaction, such as styrene-acrylic and styrene-butadiene. The binder resin is not particularly limited as long as it is a resin obtained by a condensation polymerization reaction or an addition polymerization reaction.

A polyester resin obtained by a condensation polymerization reaction is a resin obtained by a condensation polymerization between a polyhydroxy compound and a polybasic acid.

Examples of the polyhydroxy compound include, but are not limited to: glycols such as ethylene glycol, diethylene glycol, triethylene glycol, and propylene glycol; alicyclic compounds having two hydroxyl groups, such as 1,4-bis (hydroxymethyl)cyclohexane; and divalent phenols such as bisphenol A. The polyhydroxy compound also involves compounds having three or more hydroxyl groups.

Examples of the polybasic acid include, but are not limited to: divalent carboxylic acids such as maleic acid, fumaric acid, phthalic acid, isophthalic acid, terephthalic acid, succinic acid, and malonic acid; and trivalent or higher polyvalent carboxylic acids such as 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane, and 1,2,7,8-octanetetracarboxylic acid. Each of these can be used alone or in combination with others.

Examples of raw material monomers of resins obtained by a condensation polymerization reaction (e.g., polyester, polyamide, polyester-polyamide) include, in addition to the above-described raw material monomers, monomers for forming amide components such as polyamines (e.g., ethylenediamine, pentamethylenediamine, hexamethylenediamine, phenylenediamine, triethylenetetramine) and aminocarboxylic acids (e.g., 6-aminocaproic acid, ε-caprolactam). Each of these can be used alone or in combination with others.

The resin obtained by a condensation polymerization reaction has a glass transition temperature (Tg) of preferably 55 degrees C. or higher, more preferably 57 degrees C. or higher, for heat resistance storage stability.

The resin obtained by an addition polymerization reaction is not particularly limited and can be suitably selected to suit to a particular application. Examples thereof include vinyl resins obtained by a radical polymerization.

Examples of raw material monomers of an addition polymerization resin include, but are not limited to, styrene, o-methylstyrene, m-methylstyrene, p-methylstyrene, α-methyl styrene, p-ethyl styrene, and vinylnaphthalene; unsaturated monoolefins such as ethylene, propylene, butylene, and isobutylene; vinyl esters such as vinyl chloride, vinyl bromide, vinyl acetate, and vinyl formate; ethylenic monocarboxylic acids and esters thereof, such as acrylic acid, methyl acrylate, ethyl acrylate, n-propyl acrylate, isopropyl acrylate, tert-butyl acrylate, amyl acrylate, methacrylic acid, methyl methacrylate, ethyl methacrylate, n-propyl methacrylate, isopropyl methacrylate, tert-butyl methacrylate, amyl methacrylate, stearyl methacrylate, methoxyethyl methacrylate, glycidyl methacrylate, phenyl methacrylate, dimethylaminoethyl methacrylate, and diethyl aminoethyl methacrylate; ethylenic monocarboxylic acid substitution products such as acrylonitrile, methacrylonitrile, and acrylamide; ethylenic dicarboxylic acids and substitution products thereof such as dimethyl maleate; and vinyl ketones such as vinyl methyl ketone. Each of these can be used alone or in combination with others.

A cross-linking agent may be added to raw material monomers of the addition polymerization resin, if necessary.

The cross-linking agent is not particularly limited and can be suitably selected to suit to a particular application. Examples thereof include, but are not limited to, divinylbenzene, divinylnaphthalene, polyethylene glycol dimethacrylate, diethylene glycol dimethacrylate, triethylene glycol diacrylate, dipropylene glycol dimethacrylate, polypropylene glycol dimethacrylate, and diallyl phthalate. Each of these can be used alone or in combination with others.

The amount of the cross-linking agent in 100 parts by mass of raw material monomers of the addition polymerization resin is preferably from 0.05 to 15 parts by mass, more preferably from 0.1 to 10 parts by mass. When the amount of the crosslinking agent is 0.05 parts by mass or more, the effect of addition of the cross-linking agent is exerted. When the amount of the cross-linking agent is 15 parts by mass or less, the toner is readily melted by heat and well fixed by heat.

It is preferable to use a polymerization initiator when polymerizing raw material monomers of the addition polymerization resin. The polymerization initiator is not particularly limited and can be suitably selected to suit to a particular application. Examples thereof include, but are not limited to: azo-based or diazo-based polymerization initiators such as 2,2'-azobis(2,4-dimethylvaleronitrile) and 2,2'-azobisisobutyronitrile; and peroxide polymerization initiators such as benzoyl peroxide, methyl ethyl ketone peroxide, and 2,4-dichlorobenzoyl peroxide. Each of these can be used alone or in combination with others.

The amount of the polymerization initiator in 100 parts by mass of raw material monomers of the addition polymerization resin is preferably from 0.05 to 15 parts by mass, more preferably from 0.5 to 10 parts by mass.

Depending on the types of raw materials used, the polymer resulted by the condensation polymerization reaction or addition polymerization reaction is either a non-linear polymer having a non-linear structure or a linear polymer having a linear structure.

In the present disclosure, both a non-linear polymer resin (A) and a linear polymer resin (B) are used.

The non-linear polymer resin refers a polymer resin having a substantial cross-linked structure, and the linear polymer resin refers to a polymer resin substantially having no cross-linked structure.

In the present disclosure, it is preferable to use a hybrid resin in which a condensation polymerization resin and an addition polymerization resin are chemically bonded, which is obtained by polymerizing monomers of the both resins using a bireactive compound reactive with the both resins.

Examples of such a bireactive compound include, but are not limited to, fumaric acid, acrylic acid, methacrylic acid, maleic acid, and dimethyl fumarate.

The amount of the bireactive compound in 100 parts by mass of raw material monomers of the addition polymerization resin is preferably from 1 to 25 parts by mass, more preferably from 2 to 10 parts by mass. When the amount of use of the bireactive compound is 1 part by mass or more, a colorant and a charge controlling agent are well dispersed in the toner, leading to high image quality. When the amount of use of the bireactive compound is parts by mass or less, the resin is advantageously not subjected to gelation.

In preparing the hybrid resin, the both reactions need not simultaneously progress or complete, and may independently progress or complete by selecting respective reaction temperatures and times. For example, the hybrid resin may be prepared as follows. In a reaction vessel containing a mixture of condensation-polymerizing raw material monomers of a polyester resin, another mixture of addition-polymerizing raw material monomers of a vinyl resin and a polymerization initiator is dropped, and these monomers are mixed in advance. After that, first, a radical polymerization reaction of the addition-polymerizing raw material monomers is completed to form the vinyl resin, and next, the reaction temperature is raised to complete a condensation polymerization reaction of the condensation-polymerizing raw material monomers to form the polyester resin.

In this method, two reactions independently proceed in the reaction vessel, and two types of resins are thereby effectively dispersed.

The above-described binder resin may be used in combination with another resin as long as the performance of the toner is not impaired. Such a resin is not particularly limited and can be suitably selected to suit to a particular application. Examples thereof include, but are not limited to, polyurethane resin, silicone resin, ketone resin, petroleum resin, and hydrogenated petroleum resin. Each of these can be used alone or in combination with others.

The amount of the binder resin in the toner is not particularly limited and can be suitably selected to suit to a particular application. Preferably, the amount of the binder resin in 100 parts by mass of the toner is from 50 to 95 parts by mass, more preferably from 75 to 90 parts by mass.

Colorant

The colorant is not particularly limited and can be suitably selected to suit to a particular application. Examples thereof include, but are not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone.

The amount of the colorant in the toner is not particularly limited and can be suitably selected to suit to a particular application. Preferably, the amount of the colorant in 100 parts by mass of the toner is from 1 to 15 parts by mass, more preferably from 3 to 10 parts by mass.

The colorant can be combined with a resin to be used as a master batch. Examples of the resin to be used for manufacturing the master batch or kneaded with the master batch include, but are not limited to: polyester resins; polymers of styrene or substitutes thereof, such as polystyrene, poly p-chlorostyrene, and polyvinyl toluene; styrene-based copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleate copolymer; and polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax. Each of these can be used alone or in combination with others.

The master batch can be obtained by mixing and kneading the resin and the colorant while applying a high shearing force thereto. To increase the interaction between the colorant and the resin, an organic solvent may be used. More specifically, the maser batch can be obtained by a method called flushing in which an aqueous paste of the colorant is mixed and kneaded with the resin and the organic solvent so that the colorant is transferred to the resin side, followed by removal of the organic solvent and moisture. This method is advantageous in that the resulting wet cake of the colorant can be used as it is without being dried. Preferably, the mixing and kneading is performed by a high shearing dispersing device such as a three roll mill.

Other Components

Other components contained in the toner are not particularly limited and can be suitably selected to suit to a particular application. Examples thereof include, but are not limited to, a charge controlling agent, a fluidity improving agent, a cleanability improving agent, and a magnetic material.

Charge Controlling Agent

The charge controlling agent is not particularly limited and can be suitably selected to suit to a particular application. Examples thereof include, but are not limited to, nigrosine dyes, triphenylmethane dyes, chromium-containing metal complex dyes, chelate pigments of molybdic acid, Rhodamine dyes, alkoxyamines, quaternary ammonium salts (including fluorine-modified quaternary ammonium salts), alkylamides, phosphorus and phosphorus-containing compounds, tungsten and tungsten-containing compounds, fluorine activators, metal salts of salicylic acid, and metal salts of salicylic acid derivatives.

Specific examples of commercially-available charge controlling agents include, but are not limited to, BONTRON 03 (nigrosine dye), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product), available from Orient Chemical Industries Co., Ltd.; TP-302 and TP-415 (molybdenum complexes of quaternary ammonium salts), available from Hodogaya Chemical Co., Ltd.; LRA-901, and LR-147 (boron complex), available from Japan Carlit Co., Ltd.; and cooper phthalocyanine, perylene, quinacridone, azo pigments, and polymers having a functional group such as a sulfonate group, a carboxyl group, and a quaternary ammonium group.

The amount of the charge controlling agent in the toner is not particularly limited and can be suitably selected to suit to a particular application. Preferably, the amount of the charge controlling agent in 100 parts by mass of the toner is from 0.1 to 10 parts by mass, more preferably from 0.2 to 5 parts by mass. When the amount is 10 parts by mass or less, chargeability of the toner is appropriate, the effect of the charge controlling agent is well exerted, the electrostatic attractive force to a developing roller is appropriate, and the fluidity of the developer is good, leading to a high image density. The charge controlling agent may be melt-kneaded with the master batch or the binder resin and thereafter dissolved or dispersed in an organic solvent, or directly dissolved or dispersed in an organic solvent. Alternatively, the charge controlling agent may be fixed on the surface of the resulting toner particles.

Fluidity Improving Agent

The fluidity improving agent is not particularly limited and can be suitably selected to suit to a particular application as long as it reforms a surface to improve hydrophobicity for preventing deterioration of fluidity and chargeability even under high-humidity environments. Specific examples thereof include, but are not limited to, silane coupling agents, silylation agents, silane coupling agents having a fluorinated alkyl group, organic titanate coupling agents, aluminum coupling agents, silicone oils, and modified silicone oils. Preferably, the above-described silica and titanium oxide are surface-treated with such a fluidity improving agent to become hydrophobic silica and hydrophobic titanium oxide, respectively.

Cleanability Improving Agent

The cleanability improving agent is not particularly limited and can be suitably selected to suit to a particular application as long as it is added to the toner for facilitating removal of the developer remaining on a photoconductor or primary transfer medium after image transfer. Specific examples thereof include, but are not limited to, metal salts of fatty acids (e.g., zinc stearate, calcium stearate) and polymer particles prepared by soap-free emulsion polymerization (e.g., polymethyl methacrylate particles, polystyrene particles). Preferably, the polymer particles have a relatively narrow particle size distribution and a volume average particle diameter of from 0.01 to 1 μm.

Magnetic Material

The magnetic material is not particularly limited and can be suitably selected to suit to a particular application. Examples thereof include, but are not limited to, iron powder, magnetite, and ferrite. In particular, those having white color tone are preferred.

A method for producing the toner according to an embodiment of the present invention is not particularly limited and can be suitably selected to suit to a particular application. For example, the method may include the processes of mixing a binder resin, a colorant, and a release agent optionally along with other components using a mixer, kneading the mixture using a kneader such as a heat roll and an extruder, cooling the kneaded product for solidification, pulverizing the cooled product using a pulverizer such as a jet mill, and classifying the pulverized product, to obtain toner base particles. The toner base particles thus prepared are then mixed with external additive particles, thus preparing a toner.

The method for producing the toner is not particularly limited, and any of bulk polymerization, solution polymerization, emulsion polymerization, and suspension polymerization can be employed.

Toner Accommodating Unit

In the present disclosure, a toner accommodating unit refers to a unit having a function of accommodating toner, that is accommodating the toner. The toner accommodating unit may be in the form of, for example, a toner accommodating container, a developing device, or a process cartridge.

The toner accommodating container refers to a container accommodating the toner.

The developing device refers to a device accommodating the toner and having a developing unit configured to develop an electrostatic latent image into a toner image with the toner.

The process cartridge refers to a combined body of an electrostatic latent image bearer (also referred to as an image bearer) with a developing unit accommodating the toner, detachably mountable on an image forming apparatus. The process cartridge may further include at least one selected from a charger, an irradiator, and a cleaner.

The toner accommodating unit according to an embodiment of the present invention is capable of forming images, when mounted on an image forming apparatus, utilizing the properties of the above-described toner that forms high-density images while preventing generation of fog images in a low-temperature low-humidity environment (at a temperature of degrees C. and a relative humidity of 15%).

Developer

A developer according to an embodiment of the present invention contains the toner according to an embodiment of the present invention and a carrier.

The carrier is not particularly limited and can be suitably selected to suit to a particular application. Preferably, the carrier comprises a core material and a resin layer coating the core material.

The core material is not particularly limited and can be suitably selected from known ones. Examples thereof include, but are not limited to, manganese-strontium (Mn—Sr) materials and manganese-magnesium (Mn—Mg) materials having a magnetization of from 50 to 90 emu/g. For securing image density, high magnetization materials such as iron powders having a magnetization of 100 emu/g or more and magnetites having a magnetization of from 75 to 120 emu/g are preferred. Additionally, low magnetization materials such as copper-zinc (Cu—Zn) materials having a magnetization of from 30 to 80 emu/g are preferred for improving image quality, because such materials are capable of reducing the impact of the magnetic brush to a photoconductor. Each of these can be used alone or in combination with others.

The core material has a volume average particle diameter (D50) of preferably from 10 to 200 μm, more preferably from 40 to 100 μm.

The material of the resin layer is not particularly limited and can be suitably selected from known resins to suit to a particular application. Examples thereof include, but are not limited to, amino resin, polyvinyl resin, polystyrene resin, halogenated olefin resin, polyester resin, polycarbonate resin, polyethylene resin, polyvinyl fluoride resin, polyvinylidene fluoride resin, polytrifluoroethylene resin, polyhexafluoropropylene resin, copolymer of vinylidene fluoride with an acrylic monomer, copolymer of vinylidene fluoride with vinyl fluoride, fluoroterpolymer (e.g., terpolymer of tetrafluoroethylene, vinylidene fluoride, and non-fluoride monomer), and silicone resin. Each of these can be used alone or in combination with others.

Specific examples of the amino resin include, but are not limited to, urea-formaldehyde resin, melamine resin, benzoguanamine resin, urea resin, polyamide resin, and epoxy resin. Specific examples of the polyvinyl resin include, but are not limited to, acrylic resin, polymethyl methacrylate resin, polyacrylonitrile resin, polyvinyl acetate resin, polyvinyl alcohol resin, and polyvinyl butyral resin. Specific examples of the polystyrene resin include, but are not limited to, polystyrene resin and styrene-acrylic copolymer resin. Specific examples of the halogenated olefin resin include, but are not limited to, polyvinyl chloride. Specific examples of the polyester resin include, but are not limited to, polyethylene terephthalate resin and polybutylene terephthalate resin.

The resin layer may contain a conductive powder, as necessary. Specific examples of the conductive powder include, but are not limited to, metal powder, carbon black, titanium oxide, tin oxide, and zinc oxide. Preferably, the conductive powder has an average particle diameter of 1 μm or less. When the average particle diameter is 1 μm or less, it is advantageously easy to control electrical resistance.

The resin layer can be formed by, for example, dissolving the silicone resin, etc., in a solvent to prepare a coating liquid and uniformly coating the surface of the core material with the coating liquid by a known coating method, followed by drying and baking. Examples of the coating method include, but are not limited to, a dipping method, a spraying method, and a brush coating method.

The solvent is not particularly limited and can be suitably selected to suit to a particular application. Examples thereof include, but are not limited to, toluene, xylene, methyl ethyl ketone, methyl isobutyl ketone, cellosolve, and butyl acetate.

The baking method is not particularly limited and may be either an external heating method or an internal heating method, such as a method using a stationary electric furnace, fluid electric furnace, rotary electric furnace, or burner furnace, and a method using microwave.

Preferably, the proportion of the resin layer in the carrier is from 0.01% to 5.0% by mass.

When the proportion is 0.01% by mass or more, the resin layer can be uniformly formed on the surface of the core material. When the proportion is 5.0% by mass or less, the thickness of the resin layer becomes appropriate and uniform carrier particles are produced.

The proportion of the carrier in the two-component developer is not particularly limited and can be suitably selected to suit to a particular application, but is preferably from 90% to 98% by mass, more preferably from 93% to 97% by mass.

In the two-component developer, preferably, 1 to 10.0 parts by mass of the toner is mixed with 100 parts by mass of the carrier.

The developer according to an embodiment of the present invention contains the toner according to an embodiment of the present invention and is therefore capable of producing high-density images while preventing generation of fog images over time in low-temperature low-humidity environments.

The developer according to an embodiment of the present invention can be suitably used for electrophotographic image formation, particularly preferably used for a developing device, a process cartridge, an image forming apparatus, and an image forming method described below according to some embodiments of the present invention.

Process Cartridge

The process cartridge according to an embodiment of the present invention includes: an electrostatic latent image bearer configured to bear an electrostatic latent image; and a developing device configured to develop the electrostatic latent image on the electrostatic latent image bearer with the developer to form a visible image. The process cartridge may further include other devices appropriately selected according to need.

The developing device includes at least a developer accommodating container containing the toner or developer according to an embodiment of the present invention, and a developer bearer configured to bear and convey the toner or developer contained in the developer accommodating container. The developing device may further include a layer thickness regulator configured to regulate the layer thickness of the toner borne by the developer bearer.

The process cartridge is detachably mountable on various image forming apparatuses. Preferably, the process cartridge is detachably mounted on the image forming apparatus according to an embodiment of the present invention to be described later.

The toner according to an embodiment of the present invention, when loaded in an image forming apparatus having the process cartridge, exhibits excellent effects in forming images. The toner according to an embodiment of the present invention thus provides a process cartridge that forms images with excellent quality.

Figure 2:
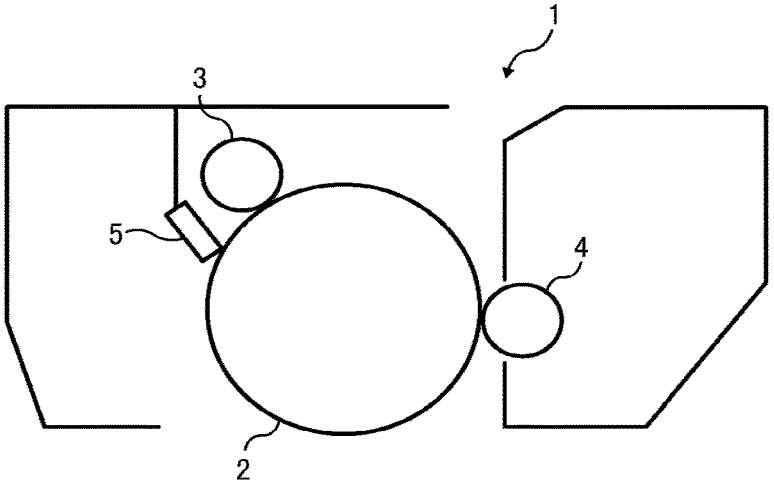
FIG. 2 is a schematic view of a process cartridge according to an embodiment of the present invention.

FIG. 2 is a schematic view of a process cartridge according to an embodiment of the present invention. A process cartridge 1 illustrated in FIG. 2 includes a photoconductor 2, a charger 3, a developing device 4, and a cleaner 5.

In an image forming apparatus having the process cartridge, the photoconductor 2 is rotationally driven at a predetermined peripheral velocity.

During rotation of the photoconductor 2, a circumferential surface of the photoconductor 2 is uniformly charged to a predetermined positive or negative potential by the charger 3, and then irradiated with light emitted from an irradiator by slit exposure or laser beam scanning exposure, so that electrostatic latent images are sequentially formed on the circumferential surface of the photoconductor 2. The electrostatic latent images thus formed are subsequently developed into toner images by the developing device 4. The toner images are sequentially transferred onto a recording medium fed from a sheet feeder to between the photoconductor 2 and a transfer device in synchronization with rotation of the photoconductor 2.

An image forming apparatus according to an embodiment of the present invention includes: an electrostatic latent image bearer; a charger configured to charge a surface of the electrostatic latent image bearer; an irradiator configured to irradiate the charged surface of the electrostatic latent image bearer to from an electrostatic latent image thereon; a developing device configured to develop the electrostatic latent image with a developer to form a visible image; a transfer device configured to transfer the visible image onto a recording medium; and a fixing device configured to fix the visible image on the recording medium. Here, the developing device is the above-described developing device according to an embodiment of the present invention.

An image forming method according to an embodiment of the present invention includes the processes of: charging a surface of an electrostatic latent image bearer; irradiating the charged surface of the electrostatic latent image bearer to form an electrostatic latent image thereon; developing the electrostatic latent image with the developer according to an embodiment of the present invention to form a visible image; transferring the visible image onto a recording medium; and fixing the visible image on the recording medium.

Figure 3:
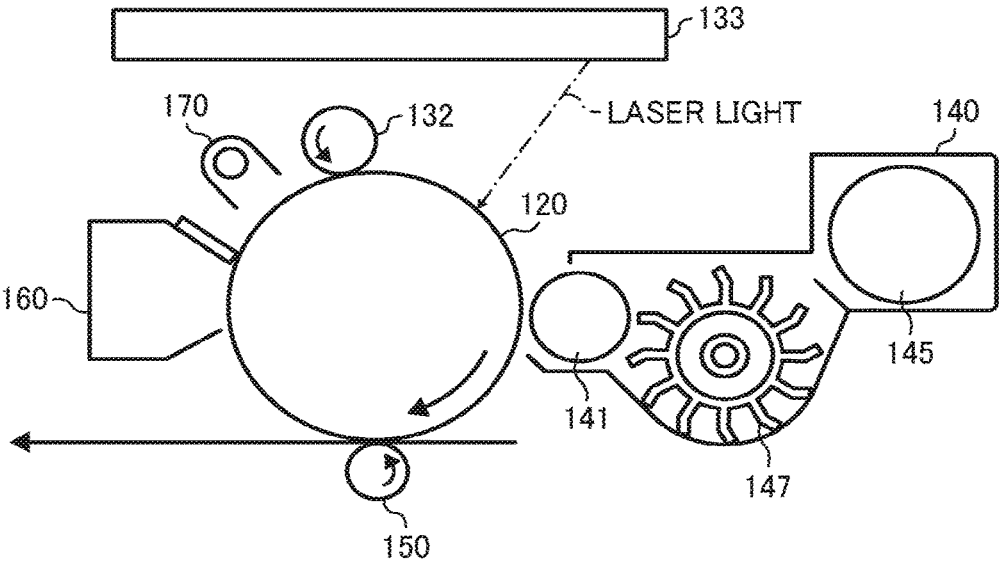
FIG. 3 is a schematic view of an image forming apparatus according to an embodiment of the present invention.

FIG. 3 is a schematic view of an image forming apparatus according to an embodiment of the present invention. This image forming apparatus includes a charger 132, an irradiator 133, a developing device 140, a transfer device 150, a cleaner 160, and a neutralization lamp 170, each of which being disposed around a photoconductor 120 having a drum-like shape. The charger 132 and the photoconductor 120 are out of contact with each other forming a gap having a distance of about 0.2 mm therebetween. The charger 132 charges the photoconductor 120 by forming an electric field in which an alternating current component is superimposed on a direct current component by a voltage applicator, thus effectively reducing charging unevenness.

Figure 4:
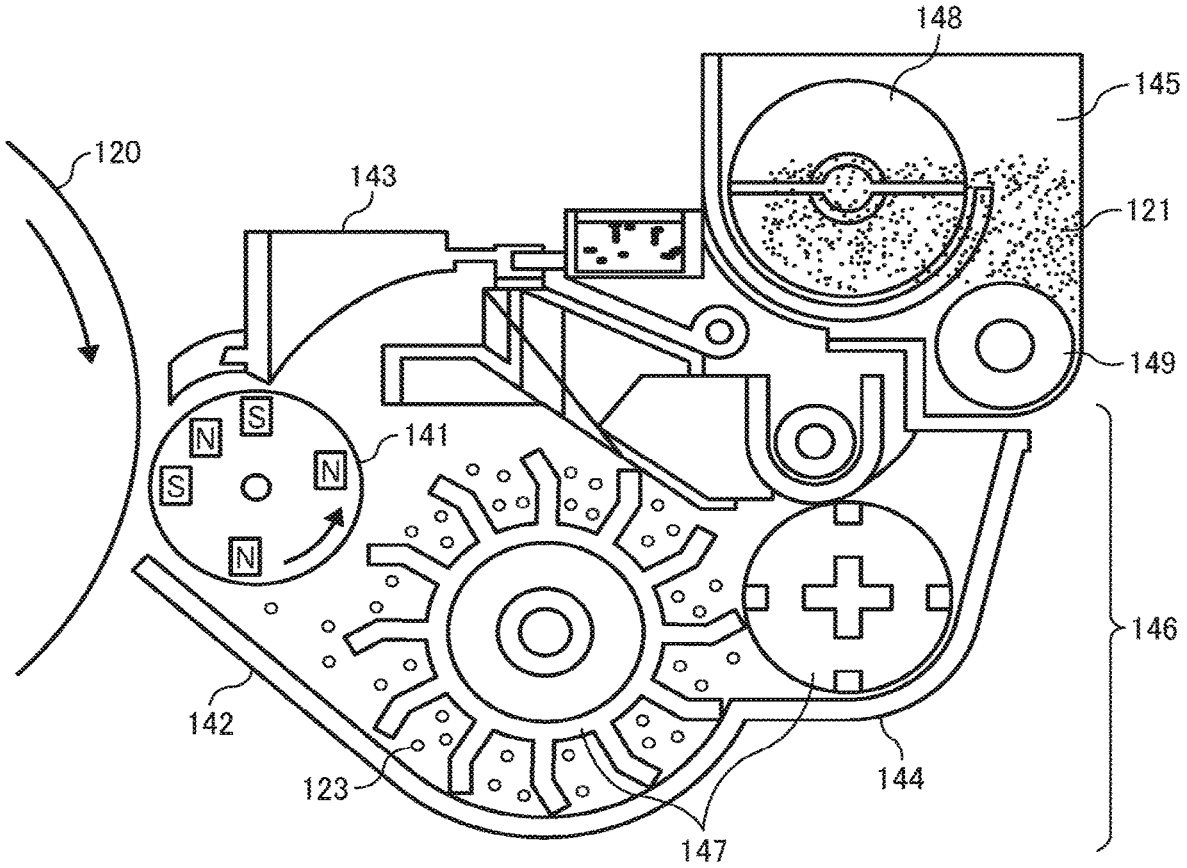
FIG. 4 is a enlarged schematic view of a main part of FIG. 3.

FIG. 4 is an enlarged schematic view of a main part of FIG. 3. A developing sleeve 141 is disposed within a space formed between the photoconductor 120 and a toner hopper 145. The developing sleeve 141 is driven to rotate in a direction indicated by arrow in FIG. 4. Inside the developing sleeve 141, magnets serving as magnetic field generators are disposed with the relative positions thereof invariant to the developing device, for forming a magnetic brush of carriers 123.

A doctor blade 143 is integrally installed to one side of a developer housing 142 opposite to a side to which a support casing 144 is installed. An edge of the doctor blade 143 is disposed facing the outer circumferential surface of the developing sleeve 141 forming a constant gap therebetween.

With the above configuration, a toner 121 is fed from the toner hopper 145 to a developer container 146 by a toner agitator 148 and a toner supply mechanism 149. The toner 121 is then stirred by a developer stirring mechanism 147 to be given a desired triboelectric/separation charge. The charged toner 121 is carried on the developing sleeve 141 together with the carriers 123 and conveyed to a position where the developing sleeve 141 faces the outer circumferential surface of the photoconductor 120. The toner 121 is electrostatically bound to an electrostatic latent image formed on the photoconductor 120, thus forming a toner image on the photoconductor 120.

The recording medium having the transferred image thereon is separated from the surface of the photoconductor and introduced to a fixing device so that the image is fixed thereon. The recording medium having the fixed image thereon is printed out the apparatus as a copy.

After the image has been transferred, the surface of the photoconductor is cleaned by removing residual toner particles by the cleaner 5 and further electrically neutralized to be repeatedly used for image formation.

The toner according to an embodiment of the present invention, when loaded in an image forming apparatus having a contact charger, exhibits excellent effects in forming images. Thus, the toner according to an embodiment of the present invention provides an image forming apparatus equipped with a charger with less ozone emission.

Figure 5:
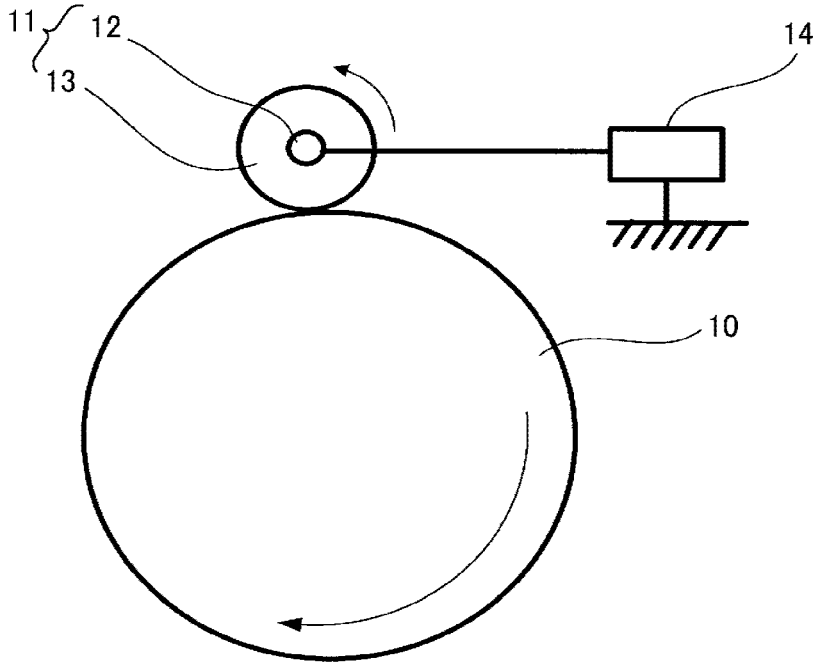
FIG. 5 is a schematic view of an image forming apparatus according to an embodiment of the present invention, having a charger that performs roller charging.

FIG. 5 is a schematic view of an image forming apparatus having a charger that performs roller charging.

A drum-shaped photoconductor 10, serving as a to-be-charged member and an image bearer, is rotationally driven at a predetermined speed (process speed) in the direction indicated by arrow in FIG. 5.

A charging roller 11, serving as a charging member, is in contact with the photoconductor 10. The charging roller 11 includes a core metal 12 and a conductive rubber layer 13 that is concentrically and integrally formed on the outer circumferential surface of the core metal 12. With both ends of the core metal 12 being rotatably held by bearings, the charging roller 11 is pressed against the photoconductor 10 with a predetermined pressing force by a pressurization assembly. In FIG. 5, the charging roller 11 rotates following rotary drive of the photoconductor 10.

The charging roller 11 is formed of a core metal having a diameter of 9 mm and a medium resistance rubber layer having a resistivity of about 100,000 Ω·cm formed thereon, so that the charging roller 11 has a diameter of 16 mm.

As illustrated in FIG. 5, the core metal 12 of the charging roller 11 is electrically connected to a power source 14, and the power source 14 applies a predetermined bias to the charging roller 11. As a result, the circumferential surface of the photoconductor 10 is uniformly charged to have predetermined polarity and potential.

Figure 6:
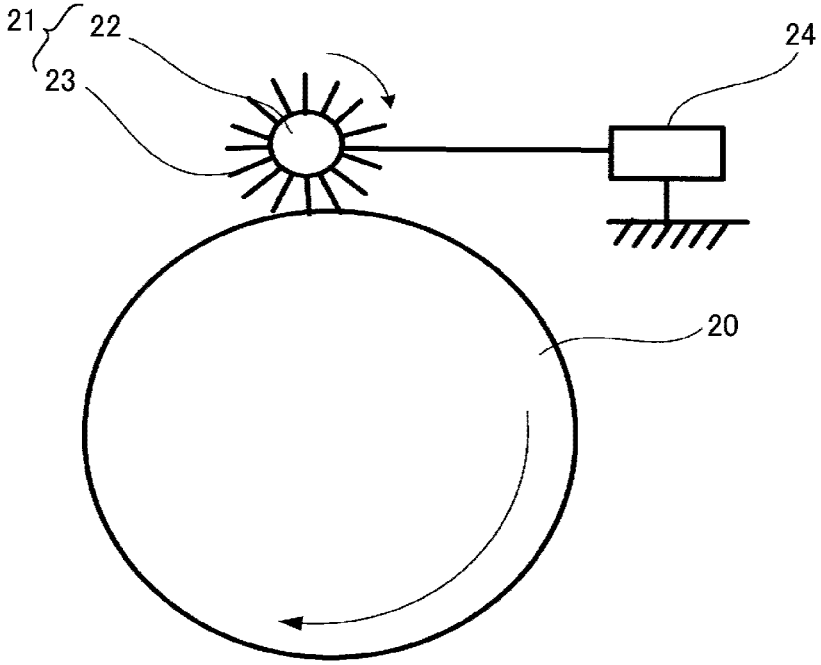
FIG. 6 is a schematic view of an image forming apparatus according to an embodiment of the present invention, having a charger that performs brush charging.

FIG. 6 is a schematic view of an image forming apparatus having a charger that performs brush charging.

A drum-shaped photoconductor 20, serving as a to-be-charged member and an image bearer, is rotationally driven at a predetermined speed (process speed) in the direction indicated by arrow in FIG. 6.

A fur brush roller 21 is in contact with the photoconductor 20 at a predetermined nip width with a predetermined pressing force against the elasticity of a brush 23.

The fur brush roller 21, serving as a contact charging member, includes a core metal 22 and the brush 23. The core metal 22 has a diameter of 6 mm and is also serving as an electrode. The brush 23 is composed of a pile fabric tape made of a conductive rayon fiber REC-B manufactured by UNITIKA LTD. and is spirally wound around the core metal 22. The fur brush roller 21 is thus formed into a roll brush having an outer diameter of 14 mm and a longitudinal length of 250 mm.

The filaments of the brush 23 are 300 denier/50 filaments, and the density is 155 filaments per square millimeter.

This roll brush has been inserted into a pipe having an inner diameter of 12 mm by being rotated in one direction, with the roll brush and the pipe being concentric with each other, and left in a high-temperature high-humidity atmosphere to make the filaments slanted.

The resistance value of the fur brush roller 21 is $1\times10^5\Omega$ when a voltage of 100 V is applied.

This resistance value has been converted from the current flowing when the fur brush roller 21 is brought into contact with a metallic drum having a diameter of 30 mm at a nip width of 3 mm and a voltage of 100 V is applied thereto.

The resistance value of the fur brush charger is preferably $10^4\Omega$ or more so as to prevent, when a low pressure-resistant defective portion such as a pinhole occurs on the photoconductor 20 as a charged member, an excessive leak current from flowing into this portion to prevent defective charging of the charging nip portion and further defective images. The resistance value is more preferably $10^7\Omega$ or less so that charges can be sufficiently injected into the surface of the photoconductor 20.

The brush may be made of, for example, REC-B as described above, REC-C, REC-M1, or REC-M10 manufactured by UNITIKA LTD., SA-7 manufactured by Toray Industries, Inc., THUNDERON manufactured by Nihon Sanmo Dyeing Co., Ltd., BELLTRON manufactured by Kanebo, Ltd. (now available from KB SEIREN, LTD.), CLACARBO manufactured by Kuraray Co., Ltd., rayon with carbon dispersed, or ROVAL manufactured by Mitsubishi Rayon Co., Ltd.

Preferably, each filament of the brush is from 3 to 10 denier, and the density of filaments is from 10 to 100 filaments/bundle and from 80 to 600 filaments/mm. The length of each filament is preferably from 1 to 10 mm.

The fur brush roller 21 is rotationally driven in a direction opposite to the direction of rotation of the photoconductor 20, so that the fur brush roller 21 is brought into contact with the surface of the photoconductor with a speed difference. The fur brush roller 21 is then applied with a predetermined charging voltage from a power source 24, so that the surface of the photoconductor is uniformly contact-charged to have predetermined polarity and potential.

In contact-charging the photoconductor 20 by the fur brush roller 21, direct injection charging is dominant. The surface of the photoconductor 20 is charged to a potential approximately equal to the charging voltage applied to the fur brush roller 21.

In the case of magnetic brush charging, as in the case of fur brush charging, the magnetic brush is in contact with the photoconductor 20 at a predetermined nip width with a predetermined pressing force against the elasticity of the brush 23.

The magnetic brush as a contact charging member may be composed of magnetic particles that are ferrite particles coated with a medium resistance resin layer. As an example, the ferrite particles is a mixture of Zn—Cu ferrite particles having an average particle diameter of 25 μm and Zn—Cu ferrite particles having an average particle diameter of 10 μm mixed at a mass ratio of 1:0.05, whose particle diameter distribution has two peaks at each of the average particle diameters.

The contact charging member may be composed of the above-described coated magnetic particles, a non-magnetic conductive sleeve for supporting the magnetic particles, and a magnet roll contained in the non-magnetic conductive sleeve. The coated magnetic particles are made to coat the conductive sleeve with a thickness of 1 mm, and a charging nip having a width of about 5 mm is formed of the conductive sleeve to face the photoconductor 20.

A gap between the conductive sleeve holding the coated magnetic particles and the photoconductor may be set to about 500 μm.

The magnet roll is rotated so that the surface of the sleeve rubs the surface of the photoconductor in the opposite direction at a speed twice as fast as the circumferential speed of the surface of the photoconductor. The photoconductor and the magnetic brush thus come into uniform contact with each other.

EXAMPLES

Further understanding can be obtained by reference to certain specific examples which are provided herein for the purpose of illustration only and are not intended to be limiting. In the following descriptions, "parts" represent "parts by mass" unless otherwise specified.

In the following Examples, the softening temperature, the glass transition temperature, and the weight average molecular weight of resins were measured as follows.

Measurement of Softening Temperature (Tm) and Glass Transition Temperature (Tg) of Resins The softening temperature (Tm) was measured according to the method described in JIS (Japanese Industrial Standards) K72101 using a capillary rheometer flowtester (manufactured by Shimadzu Corporation). First, 1 $cm^3$ of a sample was applied with a load of 20 $kg/cm^2$ by a plunger, while being heated at a temperature rising rate of 6 degrees C./min, to be extruded from a nozzle having a diameter of 1 mm and a length of 1 mm. As a result, a plunger drop amount-temperature curve, which was an S-shaped curve, was drawn. The height of the S-shaped curve was defined as h, and the temperature corresponding to h/2 (i.e., the temperature at which half the resin flowed out) was taken as the softening temperature (Tm).

The glass transition temperature (Tg) was measured using a differential scanning calorimeter (DSC-60 manufactured by Shimadzu Corporation) by subjecting the sample to heating from room temperature (25 degrees C.) to 200 degrees C. at a rate of 10 degrees C./min, then cooling to room temperature at a rate of 10 degrees C./min, and heating again a rate of 10 degrees C./min. In the resulted curve, the height between the baseline below the glass transition point and the other baseline above the glass transition point was defined as h, and the temperature corresponding to ½ of h was taken as the glass transition temperature (Tg).

Weight Average Molecular Weight (Mw) of Resins

The weight average molecular weight was measured using a GPC (gel permeation chromatography) instrument HLC-8220GPC (available from Tosoh Corporation) equipped with triple columns TSKgel SuperHZM-H 15 cm (available from Tosoh Corporation). Specifically, the columns were stabilized in a heat chamber at 40 degrees C. Next, tetrahydrofuran (THF) was allowed to flow in the columns at a flow rate of 1 mL/min, and 50 to 200 μL of a 0.05-0.6% by mass THF solution of a sample was injected into the instrument to measure the weight average molecular weight of the sample. The molecular weight of the sample was determined from a calibration curve, created with several types of monodisperse polystyrene standard samples, that shows the relation between the logarithmic values of molecular weights and the number of counts.

The polystyrene standard samples were those having respective weight average molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ (available from Pressure Chemical Co. or Tosoh Corporation).

As the detector, a refractive index (RI) detector was used.

Production Example 1 of Non-Linear Polyester Resin

Production of Non-Linear Polyester Resin A

In a flask equipped with a stainless steel stirrer, a flow-down condenser, a nitrogen gas inlet tube, and a thermometer, 9.0 mol of fumaric acid, 3.5 mol of trimellitic anhydride, 5.5 mol of bisphenol A (2,2) propylene oxide, 3.5 mol of bisphenol A (2,2) ethylene oxide were stirred and subjected to a condensation polymerization reaction under a nitrogen atmosphere at 230 degrees C. Thus, a non-linear polyester resin A was prepared.

The non-linear polyester resin A was found to have a softening temperature (Tm) of 145.1 degrees C., a glass transition temperature (Tg) of 61.5 degrees C., and a weight average molecular weight (Mw) of 82,000.

Production Example 2 of Linear Polyester Resin

Production of Linear Polyester Resin B

In a flask equipped with a stainless steel stirrer, a flow-down condenser, a nitrogen gas inlet tube, and a thermometer, 7 mol of terephthalic acid, 2.5 mol of trimellitic anhydride, 5.5 mol of bisphenol A (2,2) propylene oxide, 3.5 mol of bisphenol A (2,2) ethylene oxide were stirred and subjected to a condensation polymerization reaction under a nitrogen atmosphere at 230 degrees C. Thus, a linear polyester resin B was prepared.

The linear polyester resin B was found to have a softening temperature (Tm) of 102.8 degrees C., a glass transition temperature (Tg) of 61.2 degrees C., and a weight average molecular weight (Mw) of 8,000.

Production Example 1 of Hybrid Resin

Production of Hybrid Resin C

In a dropping funnel, 18 mol of styrene and 4.5 mol of butyl methacrylate as addition-polymerization reactive monomers, and 0.35 mol of t-butyl hydroperoxide as a polymerization initiator were put. In a flask equipped with a stainless steel stirrer, a flow-down condenser, a nitrogen gas inlet tube, and a thermometer, 9.0 mol of fumaric acid as an addition-polymerization-condensation-polymerization bireactive monomer, 3.5 mol of trimellitic anhydride, 5.5 mol of bisphenol A (2,2) propylene oxide, and 3.8 mol of bisphenol A (2,2) ethylene oxide as condensation-polymerization reactive monomers, and 58 mol of dibutyltin oxide as an esterification catalyst were stirred under a nitrogen atmosphere at 138 degrees C., and the mixture of addition-polymerization raw materials was dropped therein from the dropping funnel over a period of 4 hours.

After that, an aging was performed for 6 hours while maintaining the temperature at 138 degrees C., then the temperature was raised to 230 degrees C. to conduct a reaction. Thus, a hybrid resin C was prepared.

The hybrid resin C was found to have a softening temperature (Tm) of 151.5 degrees C. and a glass transition temperature (Tg) of 62.1 degrees C.

The hybrid resin C was found to be a composition of a polyester resin (having a weight average molecular weight (Mw) of 48,000) and a styrene-acrylic copolymer resin (having a weight average molecular weight (Mw) of 190,000), and the mass ratio therebetween was 78/22.

Preparation of Toner Base Particles A

Toner Materials

Non-linear polyester resin A: 42 parts by mass

Linear polyester resin B: 45 parts by mass

Hybrid resin C: 13 parts by mass

Carbon black: 18 parts by mass

Charge controlling agent (SPILON BLACK TR-H manufactured by Hodogaya Chemical Co., Ltd.): 2.5 parts by mass Release Agent (Low-molecular-weight polypropylene, having a weight average molecular weight (Mw) of 5,500): 2.6 parts by mass The above toner materials were stirred and mixed using a HENSCHEL MIXER. The mixture was heat-melted using a roll mill at a temperature of from 125 to 130 degrees C. for 40 minutes, then cooled to room temperature (25 degrees C.). The resulted kneaded product was pulverized and classified using a jet mill. Thus, toner base particles A were prepared having a volume average particle diameter of 7.0 μm and a particle diameter distribution in which the proportion of particles having a particle diameter of 5 μm or less was 35% by number.

Preparation of Toner Base Particles B

Toner Material s

Release Agent (Low-molecular-weight polypropylene, having a weight average molecular weight (Mw) of 5,500): 5.0 parts by mass Toner base particles B were prepared in the same manner as the toner base particles A except for the above change in toner materials.

Preparation of Toner Base Particles C

Toner Materials

Release Agent (Low-molecular-weight polypropylene, having a weight average molecular weight (Mw) of 5,500): 2.4 parts by mass Toner base particles C were prepared in the same manner as the toner base particles A except for the above change in toner materials.

Preparation of Toner Base Particles D

Toner Materials

Release Agent (Low-molecular-weight polypropylene, having a weight average molecular weight (Mw) of 5,500): 5.2 parts by mass Toner base particles D were prepared in the same manner as the toner base particles A except for the above change in toner materials.

In the present disclosure, pseudoboehmite particles were prepared by the following procedure.

An aluminum alkoxide is once hydrolyzed to obtain an alumina hydrate. The alumina hydrate thus obtained was purified by a distillation operation to obtain a high-purity aluminum alkoxide. By changing the hydrolysis conditions and drying conditions of the aluminum alkoxide, alumina hydrates, i.e., pseudoboehmite particles, of various phases having different particle sizes were obtained.

Preparation of Pseudoboehmite Particle Base A

Pseudoboehmite particles were prepared based on the above-described procedure. It was confirmed by X-ray diffraction that a pseudoboehmite phase had been created. The particles thus prepared was found to have a d50 of 8 nm and a ratio (Dv/Dn) of volume average particle diameter Dv to number average particle diameter Dn of 1.3, as measured by a laser diffraction particle size distribution analyzer LA-750 (manufactured by HORIBA, Ltd.). Thus, a pseudoboehmite particle base A was prepared.

Preparation of Pseudoboehmite Particle Base B

Pseudoboehmite particles were prepared based on the above-described procedure. It was confirmed by X-ray diffraction that a pseudoboehmite phase had been created. The particles thus prepared was found to have a d50 of 120 nm and a ratio Dv/Dn of 1.2, as measured by a laser diffraction particle size distribution analyzer LA-750 (manufactured by HORIBA, Ltd.). Thus, a pseudoboehmite particle base B was prepared.

Preparation of Pseudoboehmite Particle Base C

Pseudoboehmite particles were prepared based on the above-described procedure. It was confirmed by X-ray diffraction that a pseudoboehmite phase had been created. The particles thus prepared was found to have a d50 of 5 nm and a ratio Dv/Dn of 1.2, as measured by a laser diffraction particle size distribution analyzer LA-750 (manufactured by HORIBA, Ltd.). Thus, a pseudoboehmite particle base C was prepared.

Preparation of Pseudoboehmite Particle Base D

Pseudoboehmite particles were prepared based on the above-described procedure. It was confirmed by X-ray diffraction that a pseudoboehmite phase had been created. The particles thus prepared was found to have a d50 of 135 nm and a ratio Dv/Dn of 1.2, as measured by a laser diffraction particle size distribution analyzer LA-750 (manufactured by HORIBA, Ltd.). Thus, a pseudoboehmite particle base D was prepared.

Preparation of Amorphous Aluminum Hydroxide Particles

Amorphous aluminum hydroxide particles were prepared. It was confirmed by X-ray diffraction that an amorphous aluminum hydroxide phase had been created. The particles thus prepared was found to have a d50 of 108 nm and a ratio Dv/Dn of 1.2, as measured by a laser diffraction particle size distribution analyzer LA-750 (manufactured by HORIBA, Ltd.).

Preparation of Bayerite Particles

Bayerite particles were prepared. It was confirmed by X-ray diffraction that a bayerite phase had been created. The particles thus prepared was found to have a d50 of 25 nm and a ratio Dv/Dn of 1.2, as measured by a laser diffraction particle size distribution analyzer LA-750 (manufactured by HORIBA, Ltd.).

Production Example 1 of External Additive AA

The pseudoboehmite particle base A was put in a reaction vessel, and a mixed solution of 4 g of heptadecafluorodecyltrimethoxysilane and 0.5 g of hexamethyldisilazane was sprayed on 100 g of the pseudoboehmite particle base powder under stirring in a nitrogen atmosphere. The pseudoboehmite particle base was then heat-stirred at 220 degrees C. for 150 minutes and then cooled. Thus, an external additive AA was prepared.

Production Example 2 of External Additive AB

The pseudoboehmite particle base A was put in a reaction vessel, and a mixed solution of 8 g of heptadecafluorodecyltrimethoxysilane and 1.8 g of hexamethyldisilazane was sprayed on 100 g of the pseudoboehmite particle base powder under stirring in a nitrogen atmosphere. The pseudoboehmite particle base was then heat-stirred at 220 degrees C. for 150 minutes and then cooled. Thus, an external additive AB was prepared.

Production Example 3 of External Additive AD

The pseudoboehmite particle base A was put in a reaction vessel, and a mixed solution of 3.8 g of heptadecafluorodecyltrimethoxysilane and 0.4 g of hexamethyldisilazane was sprayed on 100 g of the pseudoboehmite particle base powder under stirring in a nitrogen atmosphere. The pseudoboehmite particle base was then heat-stirred at 220 degrees C. for 150 minutes and then cooled. Thus, an external additive AD was prepared.

Production Example 4 of External Additive BA

The pseudoboehmite particle base B was put in a reaction vessel, and a mixed solution of 4 g of heptadecafluorodecyltrimethoxysilane and 0.5 g of hexamethyldisilazane was sprayed on 100 g of the pseudoboehmite particle base powder under stirring in a nitrogen atmosphere. The pseudoboehmite particle base was then heat-stirred at 220 degrees C. for 150 minutes and then cooled. Thus, an external additive BA was prepared.

Production Example 5 of External Additive BB

The pseudoboehmite particle base B was put in a reaction vessel, and a mixed solution of 8 g of heptadecafluorodecyltrimethoxysilane and 1.8 g of hexamethyldisilazane was sprayed on 100 g of the pseudoboehmite particle base powder under stirring in a nitrogen atmosphere. The pseudoboehmite particle base was then heat-stirred at 220 degrees C. for 150 minutes and then cooled. Thus, an external additive BB was prepared.

Production Example 6 of External Additive BE

The pseudoboehmite particle base B was put in a reaction vessel, and a mixed solution of 8.2 g of heptadecafluorodecyltrimethoxysilane and 2.0 g of hexamethyldisilazane was sprayed on 100 g of the pseudoboehmite particle base powder under stirring in a nitrogen atmosphere. The pseudoboehmite particle base was then heat-stirred at 220 degrees C. for 150 minutes and then cooled. Thus, an external additive BE was prepared.

Production Example 7 of External Additive CB

The pseudoboehmite particle base C was put in a reaction vessel, and a mixed solution of 8 g of heptadecafluorodecyltrimethoxysilane and 1.8 g of hexamethyldisilazane was sprayed on 100 g of the pseudoboehmite particle base powder under stirring in a nitrogen atmosphere. The pseudoboehmite particle base was then heat-stirred at 220 degrees C. for 150 minutes and then cooled. Thus, an external additive CB was prepared.

Production Example 8 of External Additive DA

The pseudoboehmite particle base D was put in a reaction vessel, and a mixed solution of 4 g of heptadecafluorodecyltrimethoxysilane and 0.5 g of hexamethyldisilazane was sprayed on 100 g of the pseudoboehmite particle base powder under stirring in a nitrogen atmosphere. The pseudoboehmite particle base was then heat-stirred at 220 degrees C. for 150 minutes and then cooled. Thus, an external additive DA was prepared.

Production Example 9 of External Additive EC

The above-prepared amorphous aluminum hydroxide particles were put in a reaction vessel, and a mixed solution of 5 g of heptadecafluorodecyltrimethoxysilane and 0.9 g of hexamethyldisilazane was sprayed on 100 g of the pseudoboehmite particle base powder under stirring in a nitrogen atmosphere. The pseudoboehmite particle base was then heat-stirred at 220 degrees C. for 150 minutes and then cooled. Thus, an external additive EC was prepared.

Production Example 10 of External Additive FC

The above-prepared bayerite particles were put in a reaction vessel, and a mixed solution of 5 g of heptadecafluorodecyltrimethoxysilane and 0.9 g of hexamethyldisilazane was sprayed on 100 g of the pseudoboehmite particle base powder under stirring in a nitrogen atmosphere. The pseudoboehmite particle base was then heat-stirred at 220 degrees C. for 150 minutes and then cooled. Thus, an external additive EC was prepared.

Production Example 11 of External Additive GA

An alumina powder having a BET specific surface area of 200 $m^2/g$ was put in a reaction vessel, and a mixed solution of 4 g of heptadecafluorodecyltrimethoxysilane and 0.5 g of hexamethyldisilazane was sprayed on 100 g of the alumina powder under stirring in a nitrogen atmosphere. The alumina powder was then heat-stirred at 220 degrees C. for 150 minutes and then cooled. Thus, an external additive GA was prepared.

Production Example 12 of External Additive HA

An alumina powder having a BET specific surface area of 20 $m^2/g$ was put in a reaction vessel, and a mixed solution of 4 g of heptadecafluorodecyltrimethoxysilane and 0.5 g of hexamethyldisilazane was sprayed on 100 g of the alumina powder under stirring in a nitrogen atmosphere. The alumina powder was then heat-stirred at 220 degrees C. for 150 minutes and then cooled. Thus, an external additive HA was prepared.

Example 1

Next, 100 parts by mass of the toner base particles A were stir-mixed with 1.2 parts by mass of a silica (R-972 manufactured by Clariant Japan K.K.) and 0.5 parts by mass of the external additive AA using a HENSCHEL MIXER under the following mixing conditions, then allowed to pass through a mesh to remove coarse particles. Thus, a toner A was prepared.

Mixing Conditions
Frequency: 80 Hz
Time: 10 min

Example 2

A toner B was prepared in the same manner as in Example 1 except for replacing the toner base particles A with the toner base particles B.

Example 3

A toner C was prepared in the same manner as in Example 1 except for replacing the external additive AA with the external additive AB.

Example 4

A toner D was prepared in the same manner as in Example 1 except for replacing the toner base particles A with the toner base particles B and replacing the external additive AA with the external additive AB.

Example 5

A toner E was prepared in the same manner as in Example 1 except for changing the amount of the external additive AA to 2.0 parts.

Example 6

A toner F was prepared in the same manner as in Example 5 except for replacing the toner base particles A with the toner base particles B.

Example 7

A toner G was prepared in the same manner as in Example 5 except for replacing the external additive AA with the external additive AB.

Example 8

A toner H was prepared in the same manner as in Example 5 except for replacing the toner base particles A with the toner base particles B and replacing the external additive AA with the external additive AB.

Example 9

A toner I was prepared in the same manner as in Example 1 except for replacing the external additive AA with the external additive BA.

Example 10

A toner J was prepared in the same manner as in Example 9 except for replacing the toner base particles A with the toner base particles B.

Example 11

A toner K was prepared in the same manner as in Example 9 except for replacing the external additive AA with the external additive BB.

Example 12

A toner L was prepared in the same manner as in Example 9 except for replacing the toner base particles A with the toner base particles B and replacing the external additive AA with the external additive BB.

Example 13

A toner M was prepared in the same manner as in Example 9 except for changing the amount of the external additive BA to 2.0 parts.

Example 14

A toner N was prepared in the same manner as in Example 13 except for replacing the toner base particles A with the toner base particles B.

Example 15

A toner O was prepared in the same manner as in Example 13 except for replacing the external additive AA with the external additive BB.

Example 16

A toner P was prepared in the same manner as in Example 13 except for replacing the toner base particles A with the toner base particles B and replacing the external additive AA with the external additive BB.

Example 17

A toner Q was prepared in the same manner as in Example 1 except for replacing the toner base particles A with the toner base particles B and replacing the external additive AA with the external additive EC in an amount of 1.0 part.

Example 18

A toner R was prepared in the same manner as in Example 17 except for replacing the external additive EC with the external additive FC.

Comparative Example 1

A toner AA was prepared in the same manner as in Example 1 except for replacing the external additive AA with the external additive GA in an amount of 2.0 parts.

Comparative Example 2

A toner AB was prepared in the same manner as in Comparative Example 1 except for changing the amount of the external additive GA to 0.5 parts.

Comparative Example 3

A toner AC was prepared in the same manner as in Comparative Example 2 except for replacing the external additive GA with the external additive HA.

Example 19

A toner AD was prepared in the same manner as in Comparative Example 1 except for replacing the toner base particles A with the toner base particles B and replacing the external additive GA with the external additive CB.

Example 20

A toner AE was prepared in the same manner as in Comparative Example 1 except for replacing the toner base particles A with the toner base particles B and replacing the external additive GA with the external additive DA in an amount of 0.5 parts.

Example 21

A toner AF was prepared in the same manner as in Comparative Example 1 except for replacing the external additive GA with the external additive BA in an amount of 0.4 parts.

Example 22

A toner AG was prepared in the same manner as in Comparative Example 1 except for replacing the external additive GA with the external additive AB in an amount of 2.1 parts.

Example 23

A toner AH was prepared in the same manner as in Comparative Example 1 except for replacing the toner base particles A with the toner base particles B and replacing the external additive GA with the external additive AD.

Example 24

A toner AI was prepared in the same manner as in Comparative Example 1 except for replacing the toner base particles A with the toner base particles B and replacing the external additive GA with the external additive BE in an amount of 0.5 parts.

Example 25

A toner AJ was prepared in the same manner as in Comparative Example 1 except for replacing the toner base particles A with the toner base particles C and replacing the external additive GA with the external additive AA in an amount of 0.5 parts.

Example 26

A toner AK was prepared in the same manner as in Comparative Example 1 except for replacing the toner base particles A with the toner base particles D and replacing the external additive GA with the external additive BA.

Measurement of Aluminum Density X1 and Fluorine Density X2 by XPS

Analysis equipment: AXIS-ULTRA (manufactured by Shimadzu Corporation)

X-ray: 15 kV, 9 mA, Hybrid

Neutralization gun: 2.0 A (F-Current), 1.3 V (F-Bias), 1.8 V (C-Balance)

Step: 0.1 eV (Narrow), 2.0 eV (Wide)

Pass E: 20 eV (Narrow), 160 eV (Wide)

Relative sensitivity coefficient: Use the relative sensitivity coefficient of Casa XPS Sample preparation: A toner sample was put in an aluminum-made chip having a cylindrical recess having a depth of 0.3 mm and a diameter of 4 mm, which was an accessory to the analysis equipment, and a flat portion of the surface was subjected to a measurement.

The aluminum density X1 and the fluorine density X2 in the outermost surface layer of the toner sample were measured by X-ray photoelectron spectroscopy (XPS) using the above-described instruments under the above-described measurement conditions, and the ratio X1/X2 was calculated. The results are presented in Table 1.

Measurement of Peak Intensity Ratio (W/R)

The peak intensity ratio (W/R) was determined from an absorbance spectrum obtained by an ATR method (total reflection method) using an FT-IR (Fourier transform infrared spectrophotometer AVATAR 370 manufactured by Thermo Electron Corporation), in which the heights of peaks specific to the release agent (wax) and the binder resin, respectively, were defined as W and R. Since the ATR method requires a smooth surface, the toner was pressure-molded to form a smooth surface. Specifically, 2.0 g of toner was pressure-molded with a load of 1 t for 60 seconds and formed into a pellet having a diameter of 20 mm.

The maximum height of a peak specific to C—H stretching of an alkyl chain of the wax (e.g., a peak observed at 2834 to 2862 $cm^{-1}$) was defined as W, and the maximum height of a peak specific to the binder resin (e.g., a peak observed at 784 to 889 $cm^{-1}$ for a polyester resin (see FIG. 1), a peak observed at 670 to 714 $cm^{-1}$ for a styrene-acrylic resin) was defined as R, and W/R was calculated as the peak intensity ratio. When the binder resin is a mixture of two or more types of resins and two or more peaks were detected, the highest peak was adopted. The toner of each Example contains a polyester resin and a styrene-acrylic copolymer resin, with the amount of the polyester resin greater and the peak thereof higher. Therefore, a peak specific to the polyester resin was adopted for the calculation.

The spectrum was converted so that the height of peak indicated absorbance. The peak intensity ratio (W/R) was calculated using absorbance values that indicated the height of peak.

Preparation of Developer

Each toner in an amount of 5% by mass was mixed with a silicone-resin-coated copper-zinc ferrite carrier having an average particle diameter of 40 μm in an amount of 95% by mass to prepare each two-component developer.

Image Evaluation

Each two-component developer was loaded in a modified machine of a copier (IMAGIO MF7070 manufactured by Ricoh Co., Ltd.) to develop images on 5,000 sheets per day in a low-temperature low-humidity environment (at a temperature of 10 degrees C. and a relative humidity of 15%). In the initial stage and after 100K (100,000) sheets were output, a white solid image and a black solid image were respectively printed on three A3-size sheets (brand: RICOH MyPaper), and visually observed to determine whether fogging had occurred. The degree of fogging was evaluated based on the following evaluation criteria. The image density (ID) of the solid image was measured by X-Rite 938 (manufactured by X-Rite Inc.) and evaluated based on the following evaluation criteria. The results are presented in Table 1.

Evaluation Criteria for Fogging (Background Stains)

A: No fogging occurred. Very good.

B: Almost no fogging occurred. Good.

C: Slight fogging occurred. Acceptable.

D: Fogging occurred. Poor.

Evaluation Criteria for Image Density

A: Image density (ID) is 1.40 or more.

B: Image density (ID) is 1.20 or more and less than 1.40.

C: Image density (ID) is 1.00 or more and less than 1.20.

D: Image density (ID) is less than 1.00.

Evaluation Criteria for Wear of Photoconductor

A: The amount of wear of photoconductor is significantly less than the specified value. (Good)

B: The amount of wear of photoconductor is equal to the specified value.

C: The amount of wear of photoconductor exceeds the specified value.

D: The amount of wear of photoconductor greatly exceeds the specified value.

Overall Evaluation

A: Meets and greatly exceeds the standard.

B: Meets and exceeds the standard.

C: Meets the standard.

D: Does not meet the standard at all.

It has been found that the toners of Examples are capable of producing high-density images while reducing wear of the surface of the electrostatic latent image bearer and preventing generation of fog images over time in low-temperature low-humidity environments.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A toner comprising:

base particles comprising a binder resin and a colorant; and external additive particles covering the base particles, the external additive particles comprising at least one member selected from the group consisting of fluorine-containing aluminum hydroxide, fluorine-containing boehmite, and fluorine-containing pseudoboehmite.

2. The toner according to claim 1, wherein the external additive particles have a particle diameter of from 8 to 120 nm.

3. The toner according to claim 1, wherein an amount of the at least one member selected from the group consisting

TABLE 1

| | Types of External Additive Particles | X1/X2 | Ratio (W/R) | Background Stains | Image Density (ID) | Wear of Photoconductor | Overall Evaluation |
|---|---|---|---|---|---|---|---|
| Example 1 | Pseudoboehmite | 2.7 | 0.05 | B | B | A | B |
| Example 2 | Pseudoboehmite | 2.7 | 0.14 | A | A | A | A |
| Example 3 | Pseudoboehmite | 5.5 | 0.05 | B | B | A | B |
| Example 4 | Pscudobochmite | 5.5 | 0.14 | B | A | A | B |
| Example 5 | Pseudoboehmite | 2.7 | 0.05 | A | B | B | B |
| Example 6 | Pseudoboehmite | 2.7 | 0.14 | B | A | B | B |
| Example 7 | Pseudoboehmite | 5.5 | 0.05 | B | B | B | B |
| Example 8 | Pseudoboehmite | 5.5 | 0.14 | A | A | B | A |
| Example 9 | Pseudoboehmite | 2.7 | 0.05 | A | B | B | B |
| Example 10 | Pseudoboehmite | 2.7 | 0.14 | B | A | B | B |
| Example 11 | Pseudoboehmite | 5.5 | 0.05 | B | B | B | B |
| Example 12 | Pseudoboehmite | 5.5 | 0.14 | A | A | B | B |
| Example 13 | Pseudoboehmite | 2.7 | 0.05 | B | B | C | B |
| Example 14 | Pseudoboehmite | 2.7 | 0.14 | B | A | C | B |
| Example 15 | Pseudoboehmite | 5.5 | 0.05 | A | B | C | B |
| Example 16 | Pseudoboehmite | 5.5 | 0.14 | B | A | C | B |
| Example 17 | Amorphous Aluminum Hydroxide Particles | 4 | 0.05 | B | B | B | B |
| Example 18 | Bayerite | 4 | 0.05 | B | B | B | B |
| Example 19 | Pseudoboehmite | 5.5 | 0.14 | C | A | C | C |
| Example 20 | Pseudoboehmite | 2.7 | 0.14 | C | A | B | C |
| Example 21 | Pseudoboehmite | 2.7 | 0.05 | C | B | B | C |
| Example 22 | Pseudoboehmite | 5.5 | 0.05 | C | B | C | C |
| Example 23 | Pseudoboehmite | 2.6 | 0.14 | C | A | B | C |
| Example 24 | Pseudoboehmite | 5.6 | 0.14 | C | A | B | C |
| Example 25 | Pseudoboehmite | 2.7 | 0.04 | B | C | B | C |
| Example 26 | Pseudoboehmite | 2.7 | 0.15 | C | A | B | C |
| Comparative Example 1 | Alumina | 2.7 | 0.05 | A | B | D | D |
| Comparative Example 2 | Alumina | 2.7 | 0.05 | B | B | D | D |
| Comparative Example 3 | Alumina | 2.7 | 0.05 | A | B | D | D |

of fluorine-containing aluminum hydroxide, fluorine-containing boehmite, and fluorine-containing pseudoboehmite is from 0.5 to 2.0 parts by mass based on 100 parts by mass of the base particles.

4. The toner according to claim 3, wherein the external additive particles have a particle diameter of from 8 to 120 nm.

5. The toner according to claim 1, wherein the toner satisfies the following formula:

$$2.7 \leq X1/X2 \text{ (atomic percent)} \leq 5.8$$

where X1 and X2 represent an aluminum density and a fluorine density, respectively, as determined by X-ray photoelectron spectroscopy.

6. The toner according to claim 1, wherein the base particles further comprise a release agent, wherein the toner satisfies the following formula:

$$0.05 \leq W/R \leq 0.14$$

where W and R represent heights of peaks specific to the release agent and the binder resin, respectively, as measured by an attenuated total reflection method using a Fourier transform infrared spectrometer.

7. A toner accommodating unit comprising:

a container; and the toner according to claim 1 accommodated in the container.

8. A developer comprising:

the toner according to claim 1; and a carrier.

9. A developing device that develops an electrostatic latent image into a visible image, comprising:

a developer container containing the developer according to claim 8; and a developer bearer configured to bear and convey the developer or the toner.

10. A process cartridge detachably mountable on an image forming apparatus, comprising:

an electrostatic latent image bearer configured to bear an electrostatic latent image; and the developing device according to claim 9.

11. An image forming apparatus comprising:

an electrostatic latent image bearer;

a charger configured to charge a surface of the electrostatic latent image bearer;

an irradiator configured to irradiate the charged surface of the electrostatic latent image bearer to from an electrostatic latent image thereon;

the developing device according to claim 9 configured to develop the electrostatic latent image with the developer to form a visible image; and a transfer device configured to transfer the visible image onto a recording medium.

12. An image forming method comprising:

charging a surface of an electrostatic latent image bearer;

irradiating the charged surface of the electrostatic latent image bearer to form an electrostatic latent image thereon;

developing the electrostatic latent image with the developer according to claim 8 to form a visible image; and transferring the visible image onto a recording medium.

13. The toner according to claim 1, wherein the external additive particles comprise fluorine-containing aluminum hydroxide.

14. The toner according to claim 1, wherein the external additive particles comprise fluorine-containing boehmite.

15. The toner according to claim 1, wherein the external additive particles comprise fluorine-containing pseudoboehmite.

16. The toner according to claim 1, wherein the external additive particles comprise fluorine-containing amorphous aluminum hydroxide.

17. The toner according to claim 1, wherein the external additive particles comprise fluorine-containing bayerite.

18. The toner according to claim 1, wherein the external additive particles consist of fluorine-containing pseudoboehmite.

* * * * *